United States Patent [19]

Nobel et al.

[11] Patent Number: 4,741,818

[45] Date of Patent: May 3, 1988

[54] ALKALINE BATHS AND METHODS FOR ELECTRODEPOSITION OF PALLADIUM AND PALLADIUM ALLOYS

[75] Inventors: Fred I. Nobel, Sands Point; James L. Martin, Merrick; Michael P. Toben, Smithtown, all of N.Y.

[73] Assignee: LeaRonal, Inc., Freeport, N.Y.

[21] Appl. No.: 24,874

[22] Filed: Mar. 17, 1987

Related U.S. Application Data

[63] Continuation of Ser. No. 808,131, Dec. 12, 1985, abandoned, which is a continuation-in-part of Ser. No. 742,258, Jun. 7, 1985, abandoned.

[51] Int. Cl.[4] ..... C25D 3/58

[52] U.S. Cl. ..... 204/44.2; 204/44.3; 204/44.4; 204/44.5; 204/44.6; 204/44; 204/43.1

[58] Field of Search ..... 204/47, 44.6, 43.1, 204/44, 44.2, 44.3, 44.4, 44.5

[56] References Cited

U.S. PATENT DOCUMENTS

| | | | |
|---|---|---|---|
| 3,458,409 | 7/1969 | Hyashi et al. | 204/44.6 |
| 3,637,474 | 1/1972 | Zuntini | 204/47 |
| 3,677,909 | 7/1972 | Yamamura et al. | 204/44.6 |
| 3,972,787 | 8/1976 | Nobel | 204/47 |
| 4,100,039 | 7/1978 | Carricchio | 204/43 N |
| 4,126,524 | 11/1978 | Hradil et al. | 204/44 |
| 4,144,141 | 3/1979 | Schuster | 204/47 |
| 4,246,077 | 1/1981 | Hradil et al. | 204/43 R |
| 4,269,671 | 5/1981 | Cohen et al. | 204/23 |
| 4,278,514 | 7/1981 | Morrissey | 204/47 |
| 4,406,755 | 9/1983 | Morrissey | 204/47 |
| 4,454,010 | 6/1984 | Trop | 204/47 |
| 4,465,563 | 8/1984 | Nobel | 204/43 N |
| 4,478,692 | 10/1984 | Nobel | 204/47 |
| 4,491,507 | 1/1985 | Herklotz et al. | 204/47 |

FOREIGN PATENT DOCUMENTS

| | | | |
|---|---|---|---|
| 3307176 | 9/1983 | Fed. Rep. of Germany | 204/47 |
| 3347384 | 7/1985 | Fed. Rep. of Germany | 204/47 |
| J57143485 | 2/1981 | Japan | 204/44.6 |
| WO82/02908 | 9/1982 | PCT Int'l Appl. | 204/44.6 |
| 2062683 | 5/1982 | United Kingdom | 204/44.6 |

OTHER PUBLICATIONS

Brenner, A., "*Electrodeposition of Alloys*", vol. I, pp. 75–80, and 619–626 Academic Press, New York, 1963.

"Bath for the Preparation of Palladium Silver Alloys," IBM Technical Disclosure Bulletin, vol. 7, No. 3, Aug. 1964.

"Electrolytic Deposition of Palladium Silver Alloy," Chemical Abstracts, vol. 74, No. 37809Z, p. 468 (1971).

"Electroplating of a Silver–Palladium Alloy from a Pyrophosphatethiocyanate Bath," Chemical Abstracts vol. 80, No. 434,026, p. 441 (1974).

Dettner et al., Hand buch der Galvano technik, Carl Hanser Verlag, Munchen (1966), p. 4, (1966).

*Primary Examiner*—R. L. Andrews

*Attorney, Agent, or Firm*—Pennie & Edmonds

[57] ABSTRACT

Alkaline aqueous electrolytes for the electrodeposition of palladium comprising a soluble palladium compound, one or more complexing agents of an organic compound containing a heterocyclic ring having one or more nitrogen atoms in the ring position, at least one carboxyl group substituted on a ring carbon, and at least one hydroxyl or carbonyl oxygen attached to a ring carbon. The palladium compound and complexing agents are soluble in the electrolyte. Optionally, one or more soluble alloying metal compounds can be added to the electrolyte when palladium alloys are to be electrodeposited therefrom. Also, methods for formulating these electrolytes and for electrodepositing palladium or palladium alloys therefrom.

46 Claims, No Drawings

ALKALINE BATHS AND METHODS FOR ELECTRODEPOSITION OF PALLADIUM AND PALLADIUM ALLOYS

CROSS REFERENCE TO RELATED APPLICATIONS

This is a continuation of application Ser. No. 808,131, filed Dec. 12, 1985, now abandoned, which is a continuation-in-part of application Ser. No. 742,258, filed June 7, 1985 now abandoned.

FIELD OF THE INVENTION

The invention relates to the electrodeposition of pure palladium or palladium alloys and to alkaline electrolytic plating solutions containing palladium metal, a complexing agent, and, when desired, one or more alloying metals.

BACKGROUND OF THE INVENTION

Electrical contacts and connectors, as used in the electronics field, are generally fabricated from copper alloys onto which is electrodeposited a thin layer of a precious metal such as gold or palladium. The electrodeposit must possess certain metallurgical properties such as corrosion resistance, freedom from porosity, wear resistance, low and stable contact resistance, ductility, etc. In most cases, gold which has been hardened with a small amount of nickel or cobalt is used as the electrodeposit.

The industry initially began to substitute palladium or palladium alloys in place of gold in an attempt to lower the cost of these contacts. Thus, the industry is continually searching for better electroplating baths and processes for depositing these metals.

Numerous electroplating solutions for pure palladium have been disclosed by the prior art. Although these solutions may contain various palladium species, a wide range of additives, and pHs ranging virtually from 0 to 14, the most commonly employed palladium plating solutions contain inorganic amine complexes of palladium. Two preferred complexes are palladosamine chloride $Pd(NH_3)_4Cl_2$ or palladium diaminodinitrite $Pd(NH_3)_2(NO_2)_2$ and baths containing these complexes are usually operable over a pH range of between about 8 and 10. It is also common to utilize a slight excess of ammonia or ammonium hydroxide to stabilize these complexes in the bath.

Such prior art plating baths have several disadvantages, including evolution of ammonia fumes, frequent replenishment of the ammonium stabilizing compound and the required use of strike baths for certain basis metals.

The present invention proposes electrolytes and methods for the electrodeposition of pure palladium or palladium alloys that present an improvement over the prior art electrolytes and their deposits.

OBJECTIVES OF THE INVENTION

An objective of this invention is to provide an alkaline electrolyte for the electrodeposition of palladium or palladium alloys. This electrolyte had a minimum attack on the basis metals being plated, and is stable so that it will not deteriorate with extended use. In this regard, the electrolyte formulation is commercially feasible and able to operate satisfactorily in modern electroplating equipment.

Another objective of this invention is to electroplate a palladium or palladium alloy by utilizing these novel electrolytes. Such palladium or palladium-alloy electrodeposits are lustrous, semi-bright to bright deposits having suitable ductility, freedom of porosity, wearability, corrosion resistance and low contact resistance. These are the physical and metallurgical characteristics which are necessary for applications involving electrical contacts and connectors.

SUMMARY OF THE INVENTION

The invention relates to an alkaline electrolyte for the electrodeposition of palladium or palladium alloys which comprises at least one soluble palladium compound, at least one complexing agent and, when desired, one or more soluble alloying metal compounds. When palladium alloy plating is desired the amount and type of the complexing agent should be sufficient to provide electrodeposition potentials of palladium and the alloying metals sufficiently close to obtain the desired palladium alloy deposits. Preferably, these deposits should have a palladium content of at least about 20%.

The complexing agent should be present in an amount sufficient to maintain the palladium and the alloying metal compounds in solution in the electrolyte. Also, the electrolyte must have a sufficiently alkaline pH to solubilize the complexing agent and metal complexes. The pH of these electrolytes normally ranges from about 8 to 14, with 12 to 14 being preferred.

The complexing agents of the invention include any organic compound which is soluble in the electrolyte and which contains at least one heterocyclic ring having at least one nitrogen atom in the ring, with at least one of the ring carbons containing a hydroxyl or carbonyl oxygen group, and the ring being substituted with at least one carboxyl group. A single four, five, six or seven member heterocyclic ring or groups of such rings may be utilized in the invention. Specifically preferred complexing agents include chelidamic acid, orotic acid, or 2-pyrrolidone-5-carboxylic acid.

The invention also relates to methods for formulating electrolytes which can be used for electroplating palladium or palladium alloys. The electrolytes are formulated by adding the palladium compound, the complexing agent, and optionally, an alloying metal compound, to water and adjusting the amount of complexing agent as well as the pH of the solution to solubilize these compounds. The electroplating methods include immersing a suitable anode and a substrate to be plated into these electrolytes and electroplating palladium or a palladium alloy thereupon by passing an electric current through the electrolyte.

DETAILED DESCRIPTION OF THE INVENTION

The invention achieves substantial improvements over prior art palladium and palladium alloy baths and plating methods by supplying an electrolyte that contains palladium and, when used, the alloying metal, in an alkaline bath. These metals are complexed by chelating or complexing agents so that their electrodeposition potentials are close enough to permit the electroplating of palladium alloys having the desired palladium content. All metal compounds in the electrolyte are complexed by the complexing agent provided. "Complexing agents" or "chelating agents" are equivalent for purposes of this invention.

The complexing agents which are suitable for this invention include any organic compound which is soluble in the electrolyte and which contains at least one heterocyclic ring having one or more nitrogen atoms in the ring, at least one carboxyl group substituted on a ring carbon and/or at least one hydroxyl or carbonyl oxygen attached to a ring carbon. When a single heterocyclic ring is utilized as a complexing agent, it preferably should contain between four and seven members. Multiple-rings are also contemplated by the invention.

The nitrogen heterocycle may be a mono, di, or tricyclic ring system which is saturated or unsaturated and fused or joined by single bonds. These compounds can be represented by the general formula:

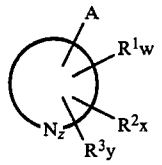

wherein:

$R^1$ is a carboxyl group attached to the ring and W is 1, 2, or 3;

$R^2$ is a carbonyl oxygen or it hydroxyl tautomer attached to the ring and X is 0, 1, 2, or 3;

$R^3$ is a substituent which may include hydroxyl, carbonyl, carboxyl, aldehyde, H, Cl, S, $HSO_3$, phenyl, $NH_2$, $NO_2$ or any other substituent which will not adversely affect the solubility of the compound in the bath, its stability or its chelation or complexing ability and Y is 0, 1, 2, or 3;

Z is 1, 2, or 3; and

A indicates an additional substituent that may be the same or similar to the presently described heterocyclic ring which will form a di or tricyclic ring system therewith.

The carboxyl group of $R_1$ is preferably attached directly to a ring carbon. However, it may also be indirectly attached to a ring carbon through another substituent as long as the solubility, stability, and complexing ability of the compound is not adversely affected. Similarly, the carbonyl oxygen and its hydroxyl tautomer may also be directly or indirectly attached to a ring carbon.

Examples of di and tricyclic rings in accordance with the invention are as follows:

carboxy uric acid

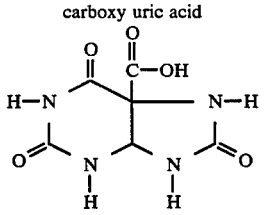

carboxy xanthine

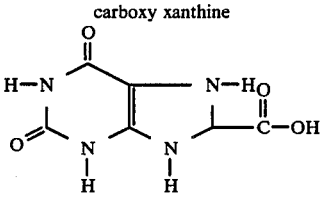

7,8-dicarboxy alloxazine

-continued

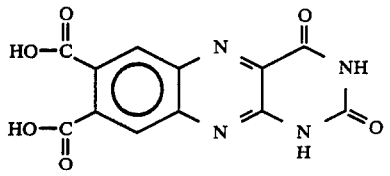

5-(4-hydroxyphenyl)-5 phenyl-2-imidazolidone-4-carboxylic acid

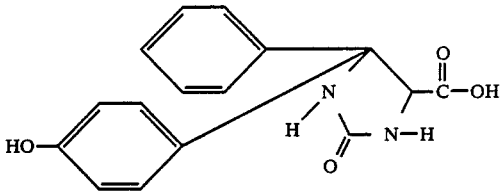

Preferred compounds include those described above which have at least 1 carboxyl group substituted on a ring carbon and at least 1 hydroxyl or carbonyl oxygen attached to a ring carbon, singly or in combination.

Other preferred compounds are those having at least two carboxyl groups attached to ring carbons. Optionally, these compounds may also have a hydroxyl or carbonyl oxygen attached to a ring carbon.

For any of these compounds to be successful in the present invention, the compound must be soluble in the electrolyte. Thus, solubilizing groups may be added to these compounds to increase their ability to remain soluble in the electrolyte. Also, the pH of the solution can be adjusted to increase the solubility of the compound in the electrolyte.

The heterocyclic ring compound must be capable of complexing the palladium compound as well as the alloying metal compounds, over an alkaline pH range of 8–14 in order that the plating potentials of the metals can be brought sufficiently close so that the desired alloy can be plated. A pH range of about 12 to 14 is usually optimum.

Examples of the preferred heterocyclic ring compounds are those that are substituted with at least one carbonyl group and at least one carboxyl group. These compounds, which must be stable and form soluble metal complexes at the operating pH of the bath, include:

chelidamic acid
orotic acid
hydantoin carboxylic acid
succinimide carboxylic acid
2-pyrrolidone-5-carboxylic acid
carboxy hydroxy pyridine
carboxy caprolactam
picolinic or dipicolinic acid
carboxy xanthine
quinoline carboxylic acid or dicarboxylic acid
2-imidazilidone-4-carboxylic acid The compound of choice should be readily soluble in the bath at the operating pH and should be capable of complexing the selected metals. Also, the metal complexes should likewise be bath soluble. The term "complexing ability" as used herein includes both the complexing and/or chelating functions of the compound.

The pH of the bath can be varied by adding a base such as lithium, sodium, ammonium, or potassium hydroxide (for raising the pH) or by adding a suitable acid to reduce the pH. When using any specific compound that is disclosed herein, the pH range to be used is that which maintains all metals in solution so that the proper alloy can be deposited containing the desired metallurgical characteristics.

The most advantageous compounds within the scope of this invention can be readily determied by those skilled in the art by routine experimentation.

Plating tests are run at the pH values which produce homogeneous solutions. The metallurgical characteristics of the deposits are then examined for suitability for the intended applications, i.e., such as for use on electrical contacts or connectors.

Not all compounds within the scope of the groups disclosed herein are capable of achieving all of the objectives of this invention. Some compounds do not achieve sufficient solubility and some of the resultant electrolytes are not stable. Some of the deposits may not have sufficient brightness, some may be too brittle and crack, others may be non-uniform, etc. All of these compounds, however, achieve some of the objectives of the invention. Those skilled in the art can readily determine which compounds or combinations of compounds are most suitable for the intended uses.

The most desirable compounds for complexing palladium from those disclosed in this invention are, as mentioned above, those heterocyclic ring compounds that contain one or more carboxyl groups attached to one or more carbons in the ring, along with one or more carbonyl or hydroxyl groups each attached to one or more carbons in the ring. Specific examples of preferred compounds are chelidamic acid, orotic acid and 2-pyrrolidone-5-carboxylic acid. These compounds are illustrated below.

Chelidamic Acid

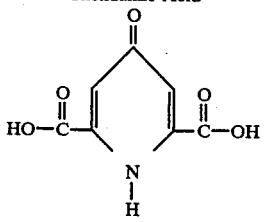

Orotic Acid

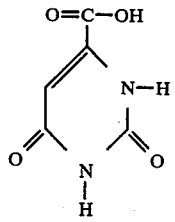

2-pyrrolidone-5 carboxylic acid

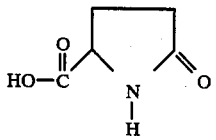

For alloy plating, two or more complexing agents can be used. In certain situations, when the preferred palladium complexing compounds are utilized, the second complexing agent can be a lesser substituted compound (i.e., an organic compound having a nitrogen heterocycle wherein the ring is substituted with one carboxyl, carbonyl or hydroxyl group. This is because alloying metals in general, will not form the same strength of complexation as palladium.

Other, secondary complexing agents may be added. These agents include ammonia, amines, amino acids, phosphonates and the like. For certain situations, bases such as ammonium hydroxide or other hydroxide compounds (i.e., alkali hydroxides and the like) are also suitable as secondary complexing agents.

If the pH of the electrolyte is high (i.e. above about 12), there may be substantial amounts of hydroxyl ion present which can also form complexes with certain metals in the electrolyte. Such metals which are capable of being complexed by hydroxyl ions include palladium (which forms palladite, $PdO_2^{=}$), zinc (zincate, $ZnO_2^{=}$), gold (aurate, $AuO_3^{=}$) and tin (stannate, $SnO_3^{=}$).

When secondary complexing agents are used and/or the solution pH is above 12, the metals may be present in the solution as an equilibrium mixture of the organic metal complex, the metal complex of the secondary complexing agent and/or the hydroxyl complex, depending upon the strength and amounts of the various metal complexes formed in the electrolyte.

The concentrations of complexing compounds or mixtures of complexing compounds used im these electrolytes can vary from 10–200 g/l or more depending on the metal concentrations and solubility. In general, the higher the metal concentration, the higher the concentration of the complexing compounds required. The minimum amount of complexing compound is that which is required to complex the metals sufficiently in solution to produce the desired electrodeposited alloy. The maximum amount of such agent is controlled by its solubility in the bath. If the concentration is too high, there will be a lack of solubility and crystallization or precipitation will take place.

The preferred concentrations of palladium and alloying elements can vary widely. Advantageously, palladium concentrations vary from about 8–30 g/l and other metal concentrations according to the values shown in Table 2.

TABLE 2

| element | preferred concentrations (g/l) |
|---|---|
| silver | 0.8–3 |
| tin | 0.5–3 |
| indium | 0.1–1.5 |
| nickel | 0.3–5 |
| copper | 0.3–3 |
| gold | 0.5–2 |
| cobalt | 0.3–5 |
| zinc | 0.5–3 |
| cadmium | 0.5–3 |

Operating temperatures can vary from ambient (i.e., 70° F.) to about 170° F., with 120°–150° F. preferred. Current densities can vary from 1–200 ASF or higher depending upon degree of agitation, temperature and metal concentration. The pH can vary from 8–14 depending upon compounds chosen, solubility and ability to complex the metals, with a range of 12 to 14 being especially advantageous.

When silver chloride is used as a source of silver metal, the strength of the complexing agent used must be such that it can complex silver in the presence of chloride ion. If this is not the case, then silver must be supplied as another metal salt such as silver nitrate or silver hydroxide, and the solution should be free of substantial amounts of chloride ions.

Palladium can be supplied in a salt form such as palladium sulphate, palladium nitrate, palladium hydroxide, or palladium chloride, if chloride does not cause precipitation. It may also be possible to separately form the palladium and or other metal complexes of the desired compound and then add the metal to the electrolyte in the form of the metal complex which is soluble in the electrolyte at the operating pH.

EXAMPLES

Having thus described the invention, the following non-limiting examples are further illustrative of the invention. In each example, a plating bath was prepared by adding the disclosed components into water.

A stock solution was prepared as follows:

palladium metal as palladium chloride—8 g/l
orotic acid—30 g/l
potassium hydroxide—sufficient to adjust the pH to 13.5
temperature 150° F.
current density 1–5 ASF

EXAMPLE 1

Pure palladium was plated from the above stock solution and a sound, uniform, bright to semibright deposit was obtained.

EXAMPLE 2

1.8 grams/liter of tin metal as tin sulfate was added to the stock solution. The deposit obtained contained 54.7% palladium and 45.3 tin. The deposit was sound, and bright to semi-bright.

EXAMPLE 3

0.3 grams/liter of indium as indium sulfate was added to the stock solution and the deposit obtained contained 90.4% palladium and 9.6% indium. The deposit was sound and bright to semi-bright.

EXAMPLE 4

1.0 g/l of nickel as nickel sulfate was added to the stock solution and the deposit contained 87.6% palladium and 12.4% nickel. The deposit was sound and bright to semi-bright.

EXAMPLE 5

0.9 g/l of copper as copper sulfate was added to the stock solution and the deposit which was obtained contained 64.2% palladium and 35.8% copper. The deposit was sound and bright to semi-bright.

EXAMPLE 6

1.1 g/l of gold as gold chloride was added to the stock solution and a deposit was obtained that contained 68.6% palladium and 31.4% gold. The deposit was sound and bright to semi-bright.

As noted above, predetermined amounts of cobalt, zinc, or cadmium metal can also be added to the stock solution to provide the desired alloy. The only limitation on the alloying metal is that it should be soluble in the electrolyte.

If more than one alloying metal is used, then a ternary, rather than binary, alloy can be electrodeposited. The following example illustrates a ternary alloy according to the invention.

EXAMPLE 7

1 g/l silver metal (as silver nitrate) and 1 g/l gold metal (as gold chloride) were added to the stock solution. The deposit was sound and bright and analyzed 43.8% palladium, 55.4% silver, and 0.6% gold.

The remaining examples illustrate various palladium-silver baths and electrodeposits.

EXAMPLE 8

| | |
|---|---|
| Pd as $PdCl_2$ | 20 g/l |
| Ag as $AgNO_3$ | 1 g/l |
| Orotic acid | 80 g/l |
| Temperature | 150° F. |
| pH adjusted to 14 with KOH | |

Hull Cell testing produced lustrous deposits from 0–20 ASF.

Alloy composition at 10 ASF was 60% Pd 40% Ag.

EXAMPLE 9

| | |
|---|---|
| Pd as Pd Orotate | 10 g/l |
| Ag as AgOH | 1 g/l |
| Orotic acid | 15 g/l |
| Temperature | 140° F. |
| pH adjusted to 14 with KOH | |

Hull Cell testing produced lustrous deposits from 0–15 ASF.

Alloy composition at 15 ASF was 60% Pd 40% Ag.

EXAMPLE 10

| | |
|---|---|
| Pd as $Pd(NO_3)_2$ | 10 g/l |
| Ag as $AgNO_3$ | 0.8 g/l |
| Chelidamic acid | 45 g/l |
| Temperature | 120° F. |
| pH adjusted to 11.8 with NaOH | |

Hull Cell testing produced lustrous deposits up to 8 ASF.

Cathode efficiency was reduced.

EXAMPLE 11

| | |
|---|---|
| Pd as Pd dipicolinate | 12 g/l |
| Ag as Ag dipicolinate | 0.9 g/l |
| Dipicolinic acid | 50 g/l |
| Temperature | 120° F. |
| pH adjusted to 11.0 with NaOH | |

Hull Cell testing produced lustrous deposits for 0–15 ASF.

EXAMPLE 12

| | |
|---|---|
| Pd as $Pd(NO_3)_2$ | 20 g/l |
| Ag as $AgNO_3$ | 1.2 g/l |
| 2-pyrrolidone-5-carboxylic acid | 60 g/l |
| Temperature | 150° F. |
| pH adjusted to 11.5 with KOH | |

Hull cell testing produced lustrous deposits to 5 ASF.

EXAMPLE 13

| | |
|---|---|
| Pd as $PdCl_2$ | 15 g/l |
| Ag as AgCl | 1 g/l |
| 5-nitroorotic acid $H_2O$ | 70 g/l |
| Temperature | 130° F. |
| pH adjusted to 10.5 with KOH | |

Hull cell testing produced lustrous deposits from 0–20 ASF.

Cathode efficiency was reduced.

EXAMPLE 14

| | |
|---|---|
| Pd as $PdCl_2$ | 12 g/l |
| Ag as $AgNO_3$ | 0.9 g/l |
| 2-hydroxynicotinic acid | 45 g/l |
| Temperature | 140° F. |
| pH adjusted to 12.0 with KOH | |

Hull cell testing produced lustrous deposits from 0–3 ASF.

EXAMPLE 15

| | |
|---|---|
| Pd as $Pd(NO_3)_2$ | 20 g/l |
| Ag as $Ag_2SO_4$ | 1.5 g/l |
| 2-pyrrolidone | 40 ml/l |
| Potassium Nitrate | 20 g/l |
| pH adjusted to 9.2 with KOH | |
| Temperature | 110° F. |

Hull cell testing produced lustrous deposits from 0–20 ASF.

EXAMPLE 16

| | |
|---|---|
| Pd as $PdSO_4$ | 12 g/l |
| Ag as $Ag_2CO_3$ | 0.9 g/l |
| Barbituric acid | 50 g/l |
| pH adjusted to 12.8 with KOH | |
| Temperature | 120° F. |

Hull cell testing produced lustrous deposits from 0–10 ASF.

EXAMPLE 17

| | |
|---|---|
| Pd as $Pd(NO_3)_2$ | 10 g/l |
| Ag as AgOH | 1 g/l |
| Uric acid | 35 g/l |
| pH adjusted to 12.5 with KOH | |
| Temperature | 130° F. |

Hull cell testing produced lustrous deposits from 0–3 ASF.

Examples 10 through 17 produced palladium-silver alloy deposits ranging from about 70:30 to 50:50 composition.

Although the examples illustrate the use of a single complexing agent in each bath, it is understood that two or more of such agents can be combined to obtain equal or better results. Also, secondary complexing agents, as described above, many be added to the electrolyte to complex the alloying metals.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

What is claimed is:

1. An alkaline aqueous electrolyte for the electrodeposition of palladium comprising: a soluble palladium compound and a organic complexing agent for primary complexing the palladium in the electrolyte, said complexing agent containing at least one heterocyclic ring having one or more nitrogen atoms in a ring position, at least one carboxyl group and at least one hydroxyl or carbonyl group and being present in an amount sufficient to maintain the palladium compound in solution in the electrolyte; said electrolyte optionally containing an amount of ammonia or ammonium compounds which is less than that necessary to stoichiometrically complex the palladium and having a sufficiently alkaline pH to solubilize the complexing agent and palladium compound.

2. The electrolyte of claim 1 wherein the complexing agent heterocyclic ring includes at least two carboxyl groups.

3. The electrolyte of claim 1 further comprising at least one bath soluble metal compound of silver, tin, indium, nickel, copper, gold, cobalt, zinc or cadmium.

4. The electrolyte of claim 3 further comprising a sufficient amount of a second complexing agent to help complex the metal compounds.

5. The electrolyte of claim 4 wherein said second complexing agent is an organic complexing agent containing at least one heterocyclic ring having one or more nitrogen atoms in the ring and at least one carboxyl, carbonyl, or hydroxyl group; a hydroxide compound; an amine; ammonia; an amino acid; or a phosphonate compound.

6. The electrolyte of claim 1 wherein the complexing agent is present in an amount between about 10 and 200 g/l.

7. The electrolyte of claim 1 wherein the pH is between about 8 and 14.

8. An alkaline aqueous electrolyte for the electrodeposition of palladium comprising a soluble palladium compound and an organic complexing agent for primarily complexing the palladium in the electrolyte, said complexing agent containing at least one heterocyclic ring having one or more nitrogen atoms in a ring position and at least two carboxyl groups and being present in an amount sufficient to maintain the palladium compound in solution in the electrolyte; said electrolyte optionally containing an amount of ammonia or ammonium compounds which is less than that necessary to stoichiometrically complex the palladium and having a sufficiently alkaline pH to solubilize the complexing agent and palladium compound.

9. The electrolyte of claim 8 wherein the complexing agent heterocyclic ring further includes at least one hydroxyl or carbonyl group.

10. The electrolyte of claim 8 further comprising at least one bath soluble metal compound of silver, tin, indium, nickel, copper, gold, cobalt, zinc or cadmium.

11. The electrolyte of claim 8 further comprising a sufficient amount of a second complexing agent to help complex the metal compounds.

12. The electrolyte of claim 11 wherein said second complexing agent is an organic complexing agent containing at least one heterocyclic ring having one or more nitrogen atoms in the ring and at least one carboxyl, carbonyl or hydroxyl group; a hydroxide compound; an amine; ammonia; or a phosphonate compound.

13. The electrolyte of claim 8 wherein the complexing agent is present in an amount between about 10 and 200 g/l.

14. The electrolyte of claim 8 wherein the pH is between about 12 and 14.

15. An alkaline aqueous electrolyte for the electrodeposition of palladium alloys comprising a soluble palladium compound, one or more soluble compounds of silver, tin, indium, nickel, copper, gold, cobalt, zinc, or cadmium, and one or more organic complexing agents for complexing the metals in the electrolyte; said complexing agents each containing at least one heterocyclic ring having one or more nitrogen atoms in a ring position, at least one carboxyl group, and at least one hydroxyl or carbonyl group and being present in an amount sufficient to maintain the metal compounds in solution in the electrolyte at electrodeposition potentials which enable an alloy to be electrodeposited during electroplating; said electrolyte optionally containing an amount of ammonia or ammonium compounds which is less than that necessary to stoichiometrically complex the palladium and having a sufficiently alkaline pH to solubilize the complexing agent and metal compounds.

16. The electrolyte of claim 15 wherein the complexing agent is chelidamic acid, orotic acid, or 2-pyrrolidone-5-carboxylic acid.

17. The electrolyte of claim 15 further comprising a sufficient amount of a second complexing agent to help complex the metal compounds.

18. The electrolyte of claim 17 wherein said complexing agent is an organic complexing agent containing at least one heterocyclic ring having one or more nitrogen atoms in a ring position and at least one carboxyl, carbonyl, or hydroxyl group; a hydroxide compound; an amine; ammonia; or a phosphonate compound.

19. A method for electroplating palladium onto a substrate which comprises:

immersing a suitable anode and the substrate into an alkaline aqueous electrolyte comprising a soluble palladium compound and an organic complexing agent for primarily complexing the palladium in the electrolyte, said complexing agent containing at least one heterocyclic ring having one or more nitrogen atoms in a ring position, at least one carboxyl group and at least one hydroxyl or carbonyl group and being present in an amount sufficient to maintain the palladium compound in solution in the electrolyte; said electrolyte optionally containing an amount of ammonia or ammonium compounds which is less than that necessary to stoichiometrically complex the palladium and having a sufficiently alkaline pH to solubilize the complexing agent and palladium compound; and electroplating palladium upon the substrate by passing an electric current through the electrolyte.

20. The method of claim 19 which further comprises maintaining the electrolyte temperature between about 70° and 170° C.

21. The method of claim 20 wherein the electroplating step utilizes a current density of between about 1 and 200 ASF.

22. A method for electroplating palladium onto a substrate which comprises:

immersing a suitable anode and the substrate into the alkaline electrolyte of claim 2; and electroplating palladium upon the substrate by passing an electric current through the electrolyte.

23. A method for electroplating palladium alloys onto a substrate which comprises:

immersing a suitable anode and the substrate into the alkaline electrolyte of claim 3; and electroplating a palladium alloy upon the substrate by passing an electric current through the electrolyte.

24. A method for electroplating palladium onto a substrate which comprises:

immersing a suitable anode and the substrate into the alkaline electrolyte of claim 8; and electroplating palladium upon the substrate by passing an electric current through the electrolyte.

25. A method for electroplating palladium alloys onto a substrate which comprises:

immersing a suitable anode and the substrate into the alkaline electrolyte of claim 10; and electroplating a palladium alloy upon the substrate by passing an electric current through the electrolyte.

26. A method for electroplating palladium alloys onto a substrate which comprises:

immersing a suitable anode and the substrate into the alkaline electrolyte of claim 15; and electroplating a palladium alloy upon the substrate by passing an electric current through the electrolyte.

27. A method for formulating an electrolyte for the electrodeposition of palladium which comprises:

adding a palladium compound and at least one organic complexing agent containing at least one heterocyclic ring having one or more nitrogen atoms in a ring position, at least one carboxyl group, and at least one hyroxyl or carbonyl group, to water to form a solution; and adjusting the amount of organic complexing agent and the pH range of the solution to complex the palladium and to solubilize the palladium compound and complexing agent, said electrolyte optionally containing an amount of ammonia or ammonium compounds which is less than that necessary to stoichiometrically complex the palladium; thus forming a stable electrolyte.

28. The method of claim 27 which further comprises adding one or more metal compounds of silver, tin, indium, nickel, copper, gold, cobalt, zinc or cadmium to the solution prior to adjusting the amount of complexing agent and pH range.

29. The method of claim 28 which further comprises adding to said solution a sufficient amount of a second complexing agent to help solubilize the metal compounds; wherein said second complexing agent is an organic compound containing at least one heterocyclic ring having one or more nitrogen atoms in a ring position and at least one carboxyl, carbonyl, or hydroxyl group; a hydroxide compound, an amine; ammonia; or a phosphonate compound.

30. The method of claim 29 which further comprises adjusting the amount of metal compounds in the electrolyte before immersing the substrate therein to obtain an electroplated palladium alloy deposit containing at least about 20 weight percent palladium.

31. A method for formulating an electrolyte for the electrodeposition of polladium alloys containing at least 20 weight percent palladium which comprises:

adding a palladium compound, at least one alloying element and at least one organic complexing agent containing at least one heterocyclic ring having one or more nitrogen atoms in a ring position and at least one carboxyl, hydroxyl or carbonyl group, to water to form a solution; and adjusting the amount of organic complexing agent and the pH range of the solution to complex the palladium and alloying element as well as to solubilize the palladium compound, alloying element and complexing agent, said electrolyte optionally containing an amount of ammonia or ammonium compounds which is less than that necessary to stoichiometrically complex the palladium thus forming a stable electrolyte;

said electrolyte containing more than 10 g/l of complexing agent and capable of providing deposits containing at least 20 weight percent palladium.

32. The method of claim 31 wherein the alloying element is one or more metal compounds of silver, tin, indium, nickel, copper, gold, cobalt, zinc or cadmium and is added to the solution prior to adjusting the amount of complexing agent and pH range.

33. The method of claim 32 which further comprises adding to said solution a sufficient amount of a second complexing agent to help solubilize the metal compounds; wherein said second complexing agent is an organic compound containing at least one heterocyclic ring having one or more nitrogen atoms in a ring position and at least one carboxyl, carbonyl, or hydroxyl group; a hydroxide compound, an amine; ammonia; or a phosphonate compound.

34. The method of claim 33 which further comprises adjusting the amount of metal compounds in the electrolyte before immersing the substrate therein to obtain an electroplated palladium alloy deposit containing at least about 50 weight percent palladium.

35. A method for electroplating palladium onto a substrate which comprises:

formulating an electrolyte according to claim 27;

immersing a suitable anode and the substrate into the electrolyte; and electroplating palladium onto the substrate by passing an electric current through the electrolyte.

36. A method for electroplating palladium alloys onto a substrate which comprises:

formulating an electrolyte according to claim 28;

immersing a suitable anode and the substrate into the electrolyte; and electroplating palladium alloys onto the substrate by passing an electric current through the electrolyte.

37. The method of claim 36 which further comprises adjusting the amount of metal compounds in the electrolyte before immersing the substrate therein to obtain an electroplated palladium alloy deposit containing at least about 20 weight percent palladium.

38. A method for electroplating palladium onto a substrate which comprises:

formulating an electrolyte according to claim 31;

immersing a suitable anode and the substrate into the electrolyte; and electroplating palladium onto the substrate by passing an electric current through the electrolyte.

39. A method for electroplating palladium alloys onto a substrate which comprises:

formulating an electrolyte according to claim 32;

immersing a suitable anode and the substrate into the electrolyte; and electroplating palladium alloys onto the substrate by passing an electric current through the electrolyte.

40. The method of claim 39 which further comprises adjusting the amount of metal compounds in the electrolyte before immersing the substrate therein to obtain an electroplated palladium alloy deposit containing at least about 50 weight percent palladium.

41. In an alkaline aqueous electrolyte for the electrodeposition of palladium, the improvement which comprises primarily complexing palladium in the electrolyte with an organic complexing agent comprising at least one heterocyclic ring compound having one or more nitrogen atoms in a ring position, at least one carboxyl group and at least one hydroxyl or carbonyl group, said complexing agent being present in an amount of greater than about 10 grams/liter to maintain the palladium compound in solution in the electrolyte at an alkaline pH.

42. In an alkaline aqueous electrolyte for the electrodeposition of palladium alloys, the improvement which comprises primarily complexing palladium and alloy elements with one or more organic complexing agents each comprising at least one heterocyclic ring compound having one or more nitrogen atoms in a ring position, at least one carboxyl group, and at least one hydroxyl or carbonyl group, said complexing agent being present in an amount of greater than about 10 grams/liter to maintain the metals in solution in the electrolyte at sufficiently close electrodeposition potentials to enable palladium alloy electroplating at an alkaline pH.

43. In an alkaline aqueous electrolyte for the electrodeposition of palladium, the improvement which comprises primarily complexing the palladium and alloying elements with at least one organic complexing agent consisting essentially of at least one heterocyclic ring compound having one or more nitrogen atoms in a ring position and at least one carbonyl, hydroxyl or carboxyl group, said complexing agent being present in an amount of greater than about 10 grams/liter to maintain the palladium and alloying element in solution in the electrolyte at an alkaline pH so that the electrolyte is capable of providing electrodeposits containing at least 20 weight percent palladium.

44. A method for electroplating palladium onto a substrate which comprises:

immersing a suitable anode and the substrate into the electrolyte of claim 41; and electroplating palladium alloys onto the substrate by passing an electric current through the electrolyte.

45. A method for electroplating palladium alloys on to a substrate which comprises:

immersing a suitable anode and the substrate into the electrolyte of claim 42; and electroplating palladium alloys onto the substrate by passing an electric current through the electrolyte.

46. A method for electroplating palladium on to a substrate which comprises:

immersing a suitable anode and the substrate into the electrolyte of claim 43; and electroplating palladium alloys onto the substrate by passing an electric current through the electrolyte.

* * * * *